US007770410B2

(12) United States Patent
Cote

(10) Patent No.: US 7,770,410 B2
(45) Date of Patent: Aug. 10, 2010

(54) BEVERAGE COOLER AND METHOD

(76) Inventor: Scott E. Cote, 26 Ruta Cir., Manchester, NH (US) 03102

( * ) Notice: Subject to any disclaimer, the term of this patent is extended or adjusted under 35 U.S.C. 154(b) by 333 days.

(21) Appl. No.: 11/759,466

(22) Filed: Jun. 7, 2007

(65) Prior Publication Data

US 2008/0302127 A1 Dec. 11, 2008

(51) Int. Cl.
*F25D 3/08* (2006.01)

(52) U.S. Cl. ..... 62/457.4; 62/457.3; 62/530

(58) Field of Classification Search ..... 62/457.4, 62/457.3, 530

See application file for complete search history.

(56) References Cited

U.S. PATENT DOCUMENTS

| | | | |
|---|---|---|---|
| 0,544,219 | A | 8/1895 | Godet |
| 1,030,325 | A | 6/1912 | Peoples et al. |
| 1,199,593 | A | 9/1916 | Muller |
| 1,689,578 | A | 10/1928 | Benz |
| 1,731,539 | A | 10/1929 | Pearson |
| 1,954,369 | A | 4/1934 | Solomon |
| 2,075,137 | A | 3/1937 | Rosen |
| 2,187,558 | A | 1/1940 | Kushima |
| 2,288,044 | A | 6/1942 | Stemme |
| 2,315,425 | A | 3/1943 | Hill et al. |
| 2,409,279 | A | 10/1946 | Hiller |
| 2,460,765 | A | 2/1949 | Palaith |
| 2,526,165 | A | 10/1950 | Smith |
| 2,622,415 | A | 12/1952 | Landers et al. |
| 3,059,452 | A | 10/1962 | Griffin |
| 4,531,383 | A | 7/1985 | Zimmermann |
| 4,584,848 | A | 4/1986 | Barnett |
| 4,745,776 | A | 5/1988 | Clark |
| 4,981,022 | A | 1/1991 | Snyder |
| 5,044,173 | A | 9/1991 | Cheng |
| 5,090,213 | A | 2/1992 | Glassman |
| 5,189,892 | A | 3/1993 | Roberts |
| 5,212,963 | A | 5/1993 | McGinnis |
| 5,284,028 | A | 2/1994 | Stuhmer |
| 5,419,154 | A | 5/1995 | Christoff |
| 5,456,090 | A | 10/1995 | McCoy |
| 5,467,877 | A | 11/1995 | Smith |
| 5,487,486 | A | 1/1996 | Meneo |
| 5,502,981 | A | 4/1996 | Sullivan |
| 5,555,741 | A | 9/1996 | Oakley |
| 5,597,087 | A | 1/1997 | Vinarsky |
| 5,609,039 | A | 3/1997 | Green et al. |
| 5,653,124 | A | 8/1997 | Weber |
| 5,655,384 | A | 8/1997 | Joslin, Jr. |
| 5,732,567 | A | 3/1998 | Anderson |
| 5,799,501 | A | 9/1998 | Leonard et al. |
| 5,875,646 | A | 3/1999 | Rich |
| 5,943,875 | A | 8/1999 | Hymes |
| 6,094,935 | A | 8/2000 | Stein |
| 6,123,065 | A | 9/2000 | Teglbjarg |
| 6,134,894 | A | 10/2000 | Searle et al. |
| 6,151,911 | A | 11/2000 | Dando et al. |
| 6,167,718 | B1 | 1/2001 | Halimi et al. |

(Continued)

*Primary Examiner*—Thomas E Denion
*Assistant Examiner*—Michael Carton

(57) ABSTRACT

A coolant base for regulating the temperature of a beverage is detachable from the beverage container with which it works. The base may be repeatedly used with the same container. The base can be chilled separately from the beverage container and, when assembled, can provide a stable, chilled beverage for an extended time. In some embodiments, the diameter of the base cooler/container system is the same as the diameter of the beverage container absent the base cooler.

19 Claims, 7 Drawing Sheets

U.S. PATENT DOCUMENTS

| | | | | |
|---|---|---|---|---|
| 6,173,581 | B1 | 1/2001 | Wyatt | |
| 6,305,175 | B1 | 10/2001 | Searle et al. | |
| 6,324,864 | B1 | 12/2001 | Stewart et al. | |
| 6,330,955 | B2 | 12/2001 | Easler, Sr. | |
| D458,086 | S | 6/2002 | Marks et al. | |
| 6,415,624 | B1 * | 7/2002 | Connors et al. | 62/457.3 |
| 6,474,096 | B1 | 11/2002 | De La Guardia | |
| 6,502,418 | B2 * | 1/2003 | Holley, Jr. | 62/457.3 |
| 6,584,800 | B1 | 7/2003 | Roth et al. | |
| 6,598,418 | B2 | 7/2003 | Holley, Jr. | |
| 6,751,982 | B2 | 6/2004 | Horen | |
| 6,758,058 | B1 | 7/2004 | Citrynell et al. | |
| 6,931,885 | B2 | 8/2005 | Citrynell et al. | |
| 7,010,935 | B2 | 3/2006 | Citrynell et al. | |
| 7,028,505 | B2 | 4/2006 | Cardinale | |
| 7,082,784 | B2 | 8/2006 | Roth et al. | |
| D550,725 | S | 9/2007 | Kingsley | |
| D559,870 | S | 1/2008 | Conlon, Jr. et al. | |
| 7,426,839 | B2 | 9/2008 | Beaudry | |
| 2002/0148247 | A1 | 10/2002 | Connors et al. | |
| 2004/0045973 | A1 * | 3/2004 | Stokes | 220/630 |
| 2004/0065109 | A1 * | 4/2004 | Metcalf | 62/457.3 |
| 2005/0210911 | A1 | 9/2005 | Drbye et al. | |
| 2006/0010903 | A1 | 1/2006 | Porter | |
| 2006/0162374 | A1 | 7/2006 | Ganser | |
| 2007/0137244 | A1 | 6/2007 | Provencher | |
| 2007/0193302 | A1 | 8/2007 | Omdoll | |
| 2008/0000259 | A1 | 1/2008 | Shewchuk | |
| 2008/0173041 | A1 | 7/2008 | Roberts | |

* cited by examiner 10
16
11
13
6
8A
14
8

18
20
28A
25
23
22
28
25
19
26
24
27

30
32
34
36
19

40
45
49
42
47
44

46
55
54
56
57
53
48
64
52
51
50

58
60
62
64
66

BEVERAGE COOLER AND METHOD

BACKGROUND

1. Field of Invention

The invention relates to methods and apparatuses for controlling the temperature of beverages and, in particular, to methods and apparatuses for keeping beverages cool.

2. Discussion of Related Art

To reduce spoilage and/or improve taste, it is often desirable to keep beverages cold for extended lengths of time. Methods, systems and apparatuses for maintaining the temperature of a beverage include passive measures such as insulated containers and active measures such as the addition of ice cubes and refrigeration. Insulated containers include portable coolers and insulating jackets that can be used to maintain a beverage temperature. Beverages and beverage containers may also be kept hot in similar manners using heaters or insulation jackets.

Temperature maintenance may be more difficult when beverages are removed from the home. For instance, in an automobile, ambient temperatures may fluctuate greatly which may accelerate any warming and spoilage. Electric power sources adequate to provide an appropriate level of refrigeration are also not typically available outside of the home.

SUMMARY

In one aspect, a detachable base for regulating the temperature of a beverage container is provided, the base comprising an upper portion including a connector for securing the base to the container, a lower portion constructed and arranged to extend below the base of the container, the upper and lower portions including a coolant wherein at least 25% of the volume of the coolant resides in the lower portion.

In another aspect, a combination is provided, the combination comprising a beverage container including a side wall, a bottom wall and a lower rim, a base including an upper portion, a lower portion and a sealed coolant in both the upper and lower portions, and a connector securing the beverage container to the base wherein at least 10% of the volume of the coolant is positioned below the lower rim of the beverage container.

In another aspect, a method of regulating the temperature of a beverage is provided, the method comprising chilling a base including a integral coolant, attaching the base to a beverage container to form a combination having an outer diameter that is no greater than the diameter of the container, the base extending at least one cm below the bottom of the beverage container, and filling the beverage container with a beverage.

The subject matter of this application may involve, in some cases, interrelated products, alternative solutions to a particular problem, and/or a plurality of different uses of a single system or article.

BRIEF DESCRIPTION OF THE DRAWINGS

In the drawing, FIG. 1 provides a cross-sectional view of an embodiment of a beverage container.

DETAILED DESCRIPTION

Figure 1:
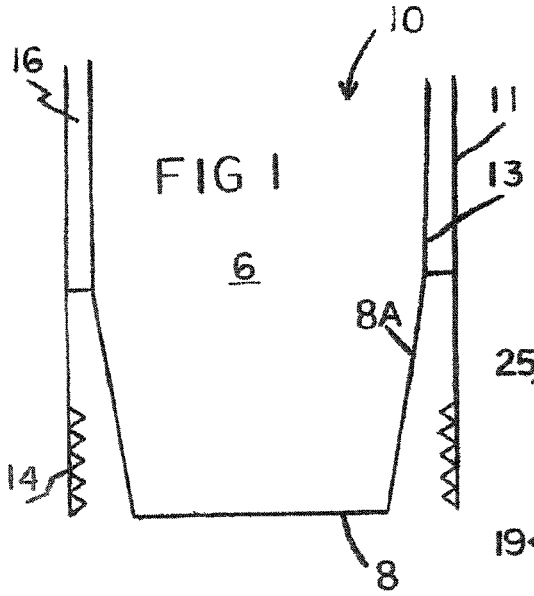

In one aspect, the invention provides a method and device for regulating the temperature of a beverage in a beverage container. The embodiments described herein are directed to methods and devices for keeping beverages cool but in some cases may be equally useful in keeping beverages warm. Beverage containers include, for example, cups, glasses, water bottles, mugs and child friendly plastic cups commonly referred to as "sippy cups." Beverage containers may be made of materials including plastic, glass and metal.

In some embodiments, the device for regulating the temperature of the beverage includes a base that is detachable from the beverage container itself. The base may be washed and stored separately from the container. The base may be chilled separately from the container by, for example, storing in a refrigerator or freezer. With or without the container attached, the base can be used to cool other items such as lunch boxes or coolers. In many embodiments the base may not come into contact with the beverage although it may be in thermal communication with the beverage. As a result, the beverage container may be washed after use while the detachable base can simply be replaced into the freezer, cooler or refrigerator. In many embodiments, the beverage container can also be used in a traditional manner separated from the base when temperature regulation is not needed or desired. The base may also be used as a cooling device independently of the beverage container.

The base may be removably (temporarily) attached to the beverage container by a connector. The connector can be firmly attached to the container so as to not separate spontaneously or upon shaking or dropping. In some embodiments, the connector is accessible to adults but not to children so that children are incapable of removing and attaching the base. Examples of connectors include, for example, threads, friction rings, friction fit and bayonet-type fittings. Each connector may include a first portion that is integral to the base and a second complementary portion integral to the container. In one set of embodiments, the connector may be a set of complementary paired threads. Threads on the base may be, for example, female or male, left or right handed, and may be paired with complementary threads on the beverage container. In other cases, a friction ring may be molded or added to either the base or the container and a complementary groove may be formed in the second piece. For a friction fit type connector, the base may slide into the container or the container may slide into the base. A bayonet-type connector may include one or more pins extending from either the base or the container and slots on the complementary piece that can be use to lock the pins in place, typically after a twist of the base. In embodiments where a "childproof" connection is desired, the connector may be designed so that a child lacks the necessary strength or dexterity to disconnect the apparatus. For instance, the threads or friction ring may require more force than can be applied by a child under age five. A bayonet type fitting may require a sequence of push, twist and pull motions that are not easily performed by a child. A friction fit apparatus may be sized so that the male portion (be it the base or the container) fits tightly into the female portion and is not easily removable by a child. In this case, the outer diameter of the male portion may be slightly greater than the internal diameter of the corresponding female portion.

In many embodiments the base and the corresponding beverage container may have similar or identical outside diameters. Containers may be specifically sized for specific reasons, such as to fit into a specific cup holder, provide for stacked storing or to fit comfortably in a small hand. Insulation or coolers that surround the outside of a container may increase the diameter of the container making it incompatible with cup holders. Such an increase in diameter may also make it difficult for children to hold the container as originally intended. Therefore, a cooling base that does not increase the diameter of the container can retain many of the attributes of the original non-cooled container.

The base may serve a variety of functions that do not include chilling a beverage. For instance, the base may help to stabilize the container when placed on a surface. For example, the base may include a coolant that can provide significant mass to the base to provide stability. The base may extend below the bottom of the container and may therefore increase the total height of the container when it is attached to the base. Measuring from the lowest point on the beverage container itself (typically a rim around the bottom of a cup) to the lowest point on the base after connecting the base to the container, the increase in total height of the combination compared to the container itself may be, for example, greater than 5 mm, greater than 10 mm or greater than 20 mm. This distance may not be equivalent to the actual height of the base itself as the base may fit partially into the container or the container may fit partially into the base. For instance, a threaded connector may account for 10 mm of height of the base but may not add to the height of the combination because it fits into receiving threads in the container.

The base may include a coolant that can be any substance that can be cooled to below room temperature and can subsequently be used to withdraw heat from a beverage or beverage container. In certain embodiments the coolant may have a higher volumetric heat capacity than water. In some embodiments the coolant may have a density of equal to or greater than 1 g/cc, greater than 2 g/cc or greater than 3 g/cc. A coolant may be a solid or a liquid and may change phase during refrigeration or during use. In some cases, a coolant that melts during use may be preferred as the system can benefit from the enthalpy of fusion, resulting in greater heat absorbance for a given mass. The coolant may be integral to the base, meaning that the coolant is not removable from the base without altering the base in some way. In some embodiments where the coolant is integral to the base, the coolant is permanently sealed inside the base. The coolant may be contained in one, two or more sections and two or more different coolants may be used in any given base. Examples of coolants include water, glycols, aqueous solutions, oils, glass, metal, alloys, plastic, carbon, sand, gels (such as BLUE ICE™) and mixtures thereof.

The amount of coolant used in a specific base can vary by application. The type and amount of coolant may be chosen using factors such as the size of the beverage container, the construction of the beverage container and the amount of beverage to be chilled. The base, including the coolant, may be capable, for example, of absorbing from the beverage greater than 500 calories, greater than 1000 calories or greater than 2000 calories of heat before warming to within 5 degrees Celsius of ambient temperature.

A base may be insulated or uninsulated. Uninsulated (single wall) embodiments may be preferred when, for instance, it is desirable to cool a second container, such as a lunch box. In these cases, the base can be used to keep a beverage container cold as well as an outer container in which the beverage container is held. In other embodiments insulated bases may be used. Thermal insulation may be provided in a number of ways such as, for example, thick walls, double walls, and sandwich layers. An insulated wall may be hollow and the void may be filled with air. Other insulative fillers include nothing (vacuum), glass and insulating plastics such as expanded foam.

In many embodiments, the upper surface of the base may be sized and shaped to conform to the lower surface of the beverage container with which the base is designed to work. In this way, the heat transfer between the beverage and the base can be maximized. Often, when assembled, there may be little or no air space between the upper surface of the base and the lower surface of the beverage container. For example, if the beverage container is a sippy cup with a concave bottom surface, the base may include a convex upper surface constructed and arranged to contact the bottom surface of the sippy cup when the cup and base are connected. Direct surface to surface contact may be obtained in some embodiments. One or both of the bottom surface of the container and the upper surface of the base may include materials designed to aid in heat transfer. For example, either or both of these surfaces may be formed from a thermally conductive material such as metal. Alternatively, one or both of these surfaces may be made from a material that exhibits improved thermal conductivity, such as a plastic including dispersed carbon or metal particles or fibers. In some embodiments the contact surfaces may contain a thermally conductive additive while base portions that are not in contact with the container do not include a thermally conductive additive. In this manner heat transfer between the coolant base and the beverage can be maximized while heat transfer between the coolant base and the ambient environment is minimized.

A base may be substantially round and/or may include features that can help in providing a firm grip on the base. For example, the base may be textured to improve its "grippability." The base may also include indents and/or protrusions in the side wall to aid in gripping. The base may be substantially polygonal in shape, including a series of flat surfaces around the perimeter. The beverage container with which the base is designed to work may also be a non-round shape and may match or complement the shape of the base.

A base may include a coolant cavity that contains an expansion region. The expansion region may be, for example, air space, a collapsible solid, a bladder or diaphragm. The bladder or diaphragm can allow the volume of the coolant cavity to change as the volume of the coolant changes. It may also provide thermal insulation between the coolant and the ambient environment. The bladder or diaphragm may be positioned in a lower portion of the base so that coolant is constantly in contact with the upper surface of the base even as its volume changes during heating/cooling and freezing/thawing cycles. This may allow for expansion/contraction of the coolant while maintaining good thermal conductivity between the coolant and the beverage.

Figure 2:
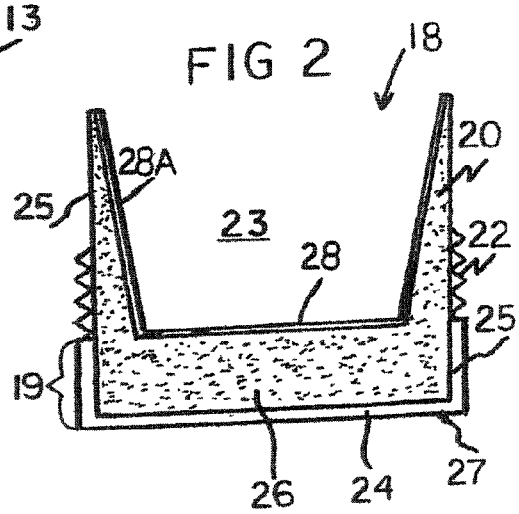
FIG. 2 provides a cross-sectional view of an embodiment of a base designed to be used in conjunction with the beverage container of FIG. 1.
Figure 3:
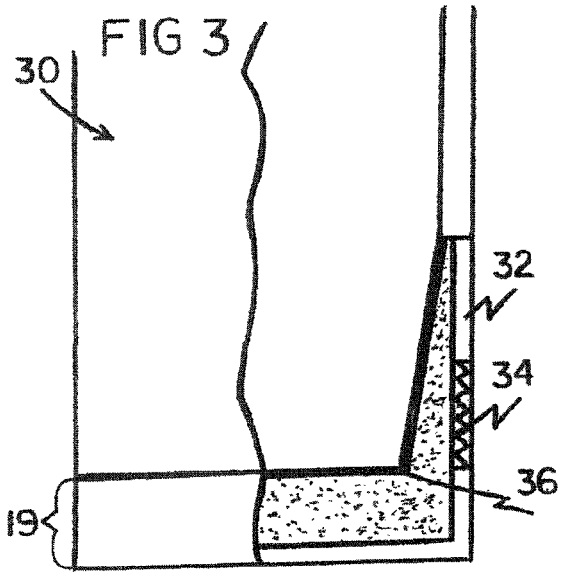
FIG. 3 provides a cutaway view of a combination of the beverage container of FIG. 1 and the base of FIG. 2.

One embodiment of a base and container system is illustrated in FIGS. 1-3. FIG. 1 provides a cross-sectional view of a portion of container 10 including outer wall 11, inner wall 13 and bottom surface 8. Inner wall 11 and bottom surface 8 form beverage cavity 6. Air space 16, formed between inner wall 11 and outer wall 13 can provide insulation and may be filled with insulative materials. Female threads 14 are sized to mate with male threads 22 on detachable base 18 of FIG. 2 to form threaded connector 34 as shown in FIG. 3. Detachable base 18 includes cavity 23 bounded by upper surface 28 and side extensions 28A. As seen in FIG. 3, cavity 23 is designed to accept beverage container 10 while contacting top surface 28 with bottom surface 8 at interface 36. In addition, side extensions 28A may be in contact with the walls of the conically shaped portion of container 10 when the combination 30 is assembled. Coolant 26 is contained in a chamber formed by walls 25 and 28 (including 28A). Conical space 20 may provide for additional contact area between the beverage container and the coolant space and this space may also allow for expansion/contraction of the coolant. Outer wall 27 forms insulation space 24 that surrounds coolant 26 below threaded area 22. Insulation space 24 may aid in reducing the transfer of heat between the ambient environment and the coolant base. Once the system is assembled, additional insulation space 32 may be formed between outer wall 11 of container 10 and wall 25 of detachable base 18. When disconnected from container 10, the entire inner surface of cavity 23 may be exposed, allowing for increased heat transfer between the coolant and the environment (which may be, for example, a freezer compartment). Thus, the base may be quickly cooled when unattached to beverage container 10 but may be well insulated from the ambient environment when assembled as shown in FIG. 3. When combination 30 is assembled, lower portion 19 of coolant base 18 is the only portion of the coolant base that extends below threaded connector 14 and 22. Lower portion 19 includes greater than 50% of the coolant. The diameter of outer wall 27 is substantially the same as that of wall 11 providing a combination 30 that exhibits a substantially uniform outer diameter along the length of the container/base combination 30. Thus, except for the added height, the combination can look substantially the same as the beverage container by itself.

Figure 4:
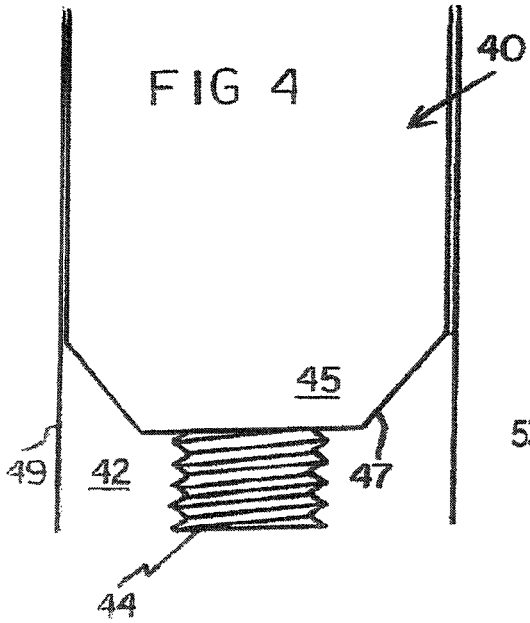
FIG. 4 provides a cross-sectional view of an embodiment of a beverage container.
Figure 5:
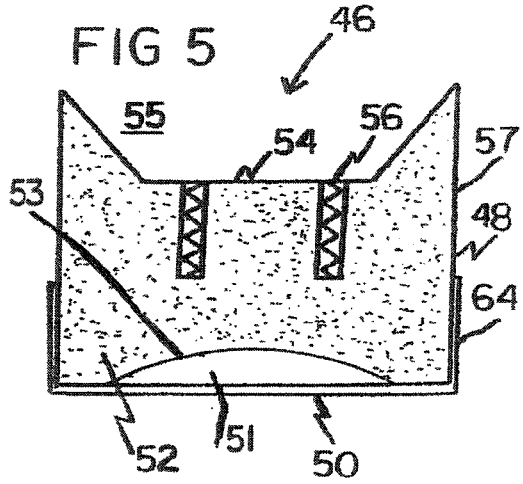
FIG. 5 provides a cross-sectional view of an embodiment of a base designed to be used in conjunction with the beverage container of FIG. 4.
Figure 6:
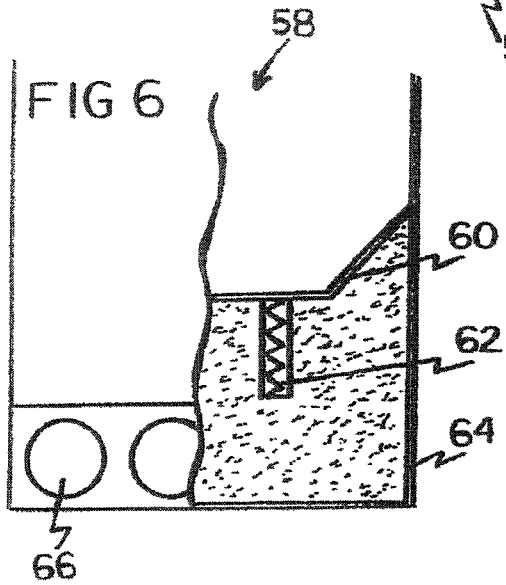
FIG. 6 provides a cutaway view of a combination of the beverage container of FIG. 4 and the base of FIG. 5.

FIGS. 4-6 provide cross-sectional views of another embodiment. FIG. 4 shows beverage container 40 including male threads on hollow connector 44. Base 46 includes complementary threads 56 and cavity 55 which is shaped similarly to cavity 45 in beverage container 40. In the embodiment shown, bottom surface 50 of base 46 is double walled, being defined by outer wall 64 and inner wall 57. Thus, bottom surface 50 may provide thermal insulation between the coolant and the ambient environment. Flexible diaphragm 53 and inner wall 57 define expansion chamber 51. As coolant 52 expands or contracts, diaphragm 53 can move upward or downward in response to the resultant change in pressure. Expansion chamber 51 may be pressurized so that coolant 52 is forced into contact with the upper surfaces of the base regardless of the temperature or phase status of the coolant. When assembled, coolant cavity 48 fits into cavity 42 of container 40. Coolant 52 fills most or all of coolant cavity 48 and can draw heat from a beverage in cavity 45 through bottom surface 47 and upper surface 54 that are in contact at junction 60. The portion of coolant base 46 surrounded by wall 57 can fit inside outer wall 49. The portion of coolant base 46 surrounded by wall 64 (the lower portion) has a diameter substantially equal to that of outer wall 49. Thus, combination 58 has a substantially constant outer diameter from top to bottom even though a significant portion of coolant base 46 extends below the bottom of beverage container 40. Outer wall 64 is substantially circular but is interrupted by indentations 66 that may be evenly or unevenly spaced around the outside of the coolant base. Threads 44 and 56 are joined in combination 58 (FIG. 6) to form connector 62 which secures the base to the beverage container.

Figure 7:
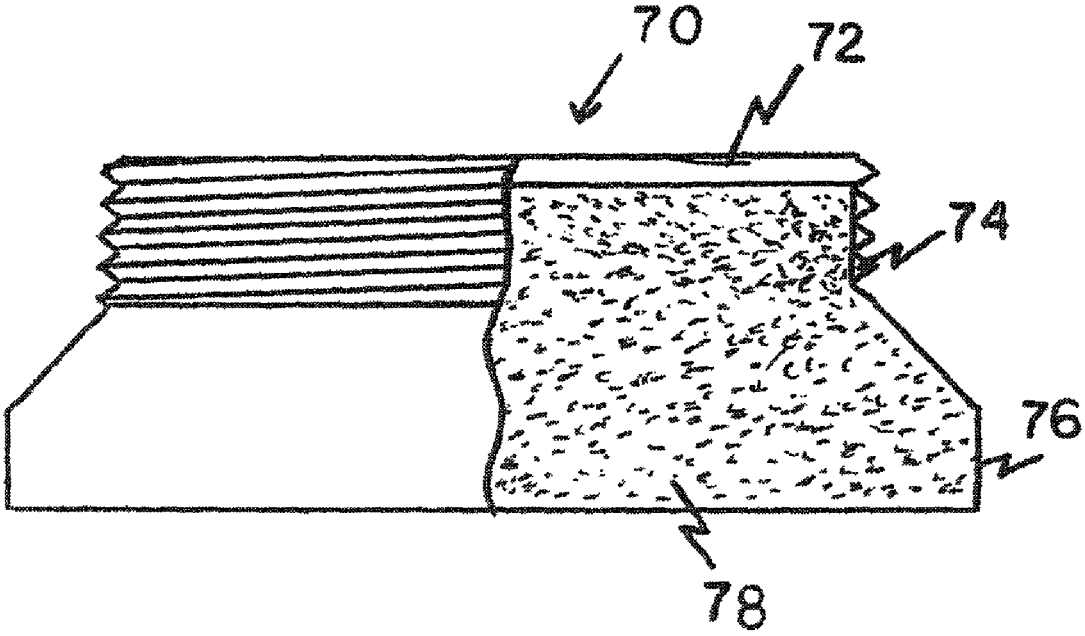
FIG. 7 provides a cutaway view of another embodiment of a base.

FIG. 7 illustrates another embodiment of a coolant base that includes base 70 bounded by upper surface 72 and outer wall 76. Upper surface 72 may be a thermally conductive material such as a metal or may be a polymer containing a thermal conductivity additive such as metal or carbon mesh or particles. Outer wall 76 may be of a different material that provides less heat transfer. Coolant 78 fills the majority of the base and below connector 74 the base flares outwardly to provide a stable platform for the container/base combination when assembled. The base may also include insulation.

Figure 8:
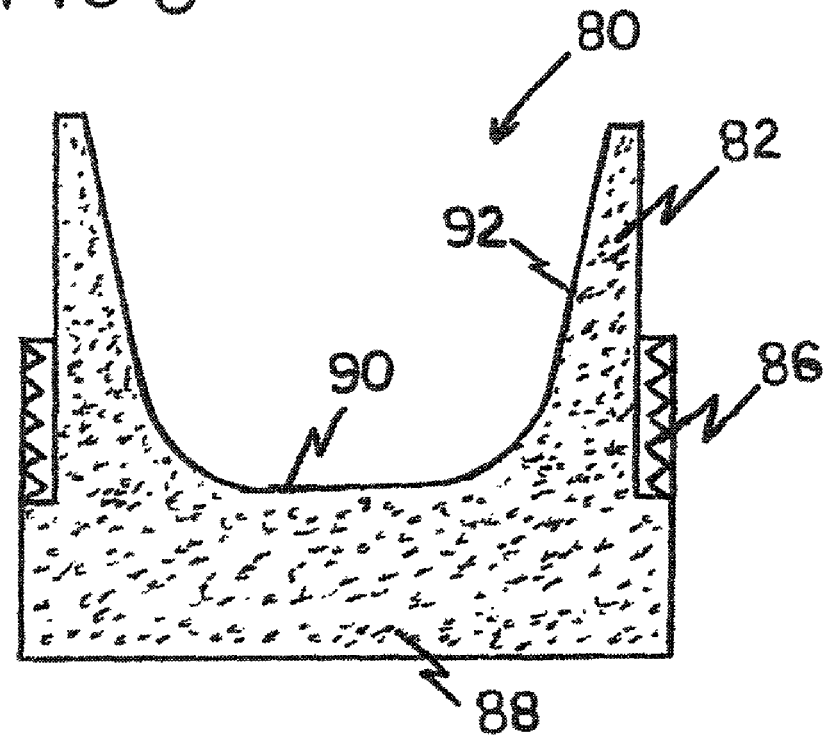
FIG. 8 provides a cutaway view of another embodiment of a base.

FIG. 8 provides a cross-sectional view of base 80 designed to be used with a beverage container that includes a concave beverage cavity. Coolant 88 may include space 82 that can provide for a greater amount of contact between coolant chamber upper surface 92 and the beverage container with which the base is used. Space 82 may also provide room for expansion and contraction of coolant. Upper surface 90 and upper side surface 92 may be shaped to conform to a rounded beverage container. Threads 86 can be used to secure the base to the beverage container.

Figure 9:
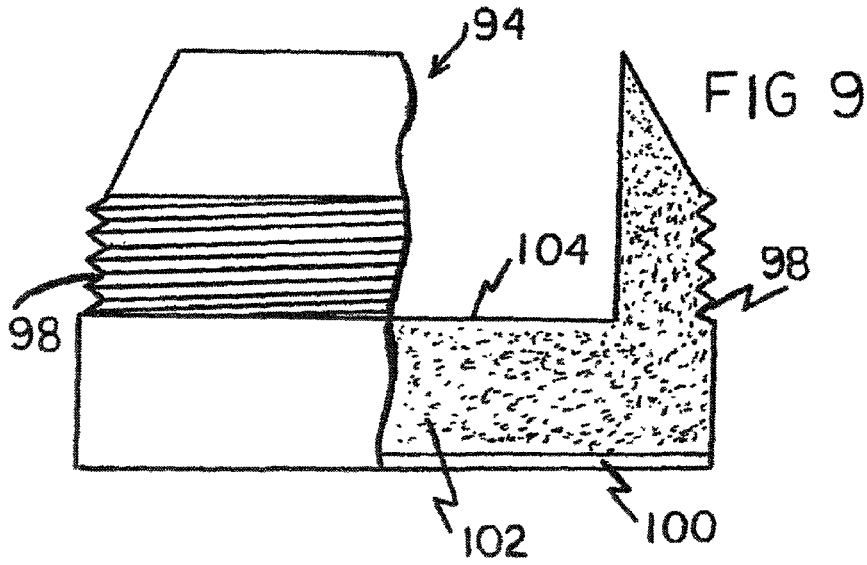
FIG. 9 provides a cutaway view of another embodiment of a base.
Figure 10:
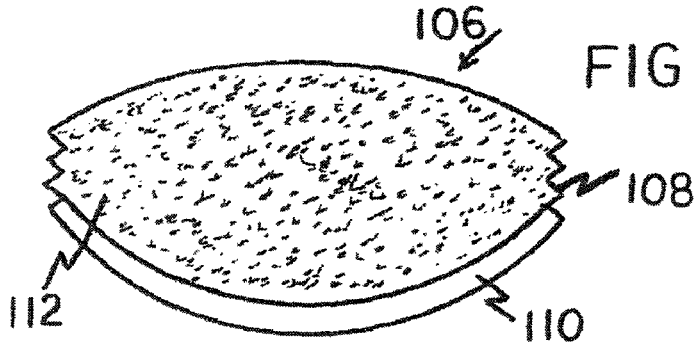
FIG. 10 provides a cross-sectional view of another embodiment of a base.
Figure 11:
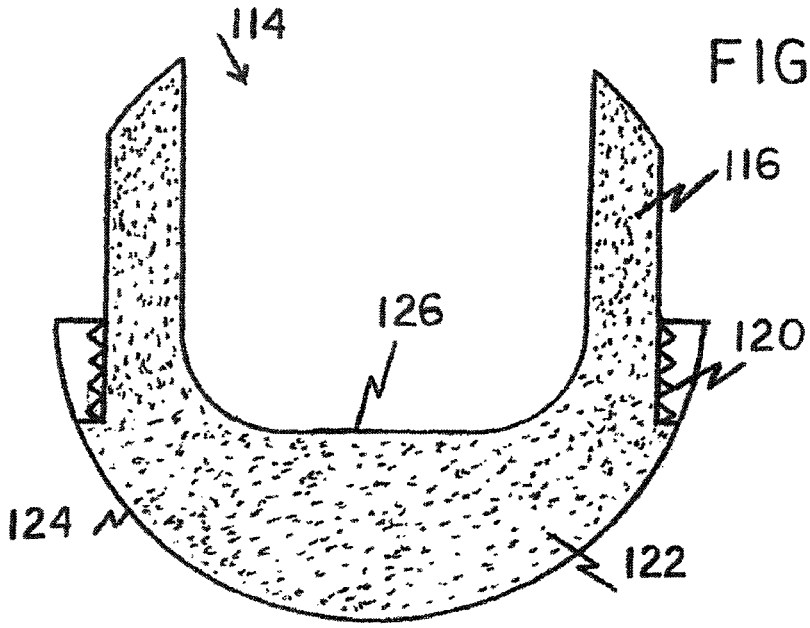
FIG. 11 provides a cross-sectional view of another embodiment of a base.

FIG. 9 illustrates an embodiment wherein base 94 includes male threads 98 and coolant 102 that is retained by upper surface 104 and lower insulated surface 100. Surface 100 may also be or may include a non-slip material, such as a rubber mat, or a heavy material, such as glass, to provide stability. FIG. 10 illustrates an embodiment of a coolant base including a convex bottom surface 110 and a convex upper surface 106. Threads 108 are designed to mate with complementary threads on a beverage container (not shown). The mass of coolant 112 can lower the center of gravity of the base/container combination and provide for righting of a tipped over container when an adequate mass is located in the lower portion of the coolant base. FIG. 11 provides an embodiment similar to that of FIG. 10 in that it includes a convex bottom surface 124 designed to re-right the combination beverage container/base into a substantially upright position after being knocked over. Base 114 can hold a large amount of coolant 122 throughout, including in annular space 116. Threads 120 can connect the base to a corresponding container (not shown) and inner surface 126 can contact the outer bottom surface of the corresponding container after assembly.

Figure 12:
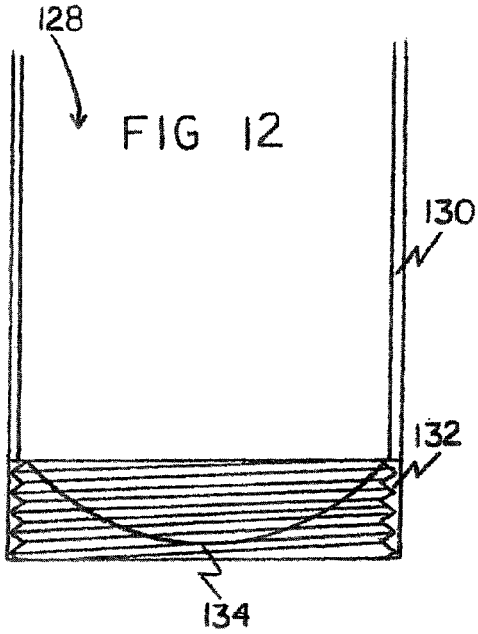
FIG. 12 provides a cross-sectional view of an embodiment of a beverage container.
Figure 13:
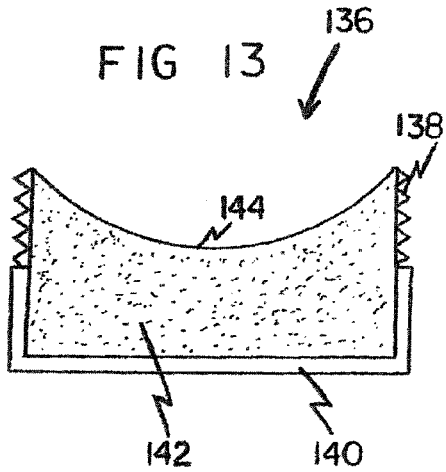
FIG. 13 provides a cross-sectional view of an embodiment of a base designed to be used in conjunction with the beverage container of FIG. 12.
Figure 14:
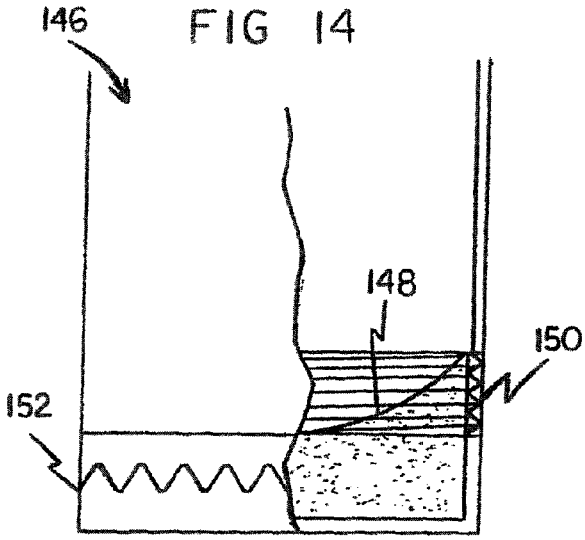
FIG. 14 provides a cutaway view of the combination of the beverage container of FIG. 12 and the base of FIG. 13.

FIGS. 12, 13 and 14 provide cross-sectional views of a container 128, a base 136 and a combination base/container 146. Insulated bottom wall 140 may serve to retard heat transfer between coolant 142 and the ambient environment. Female threads 132 can be threaded to male threads 138 to form threaded connection 150. Concave upper surface 144 is substantially in contact with convex lower surface 134 at interface 148 when assembled as shown in FIG. 14. "Substantial contact" means that at least portions of the two surfaces are in contact with each other although specific sections may not be in contact due to surface imperfections. Substantial contact between these surfaces can aid in heat transfer between coolant 142 and a beverage in container 128. Protrusion 152 provides for decoration as well as for improved gripping of the base when connecting or disconnecting the base to the container. Walls 130 and 150 may be double layer and may include insulation. The outer diameter of both the base and the container are substantially the same.

Figure 15:
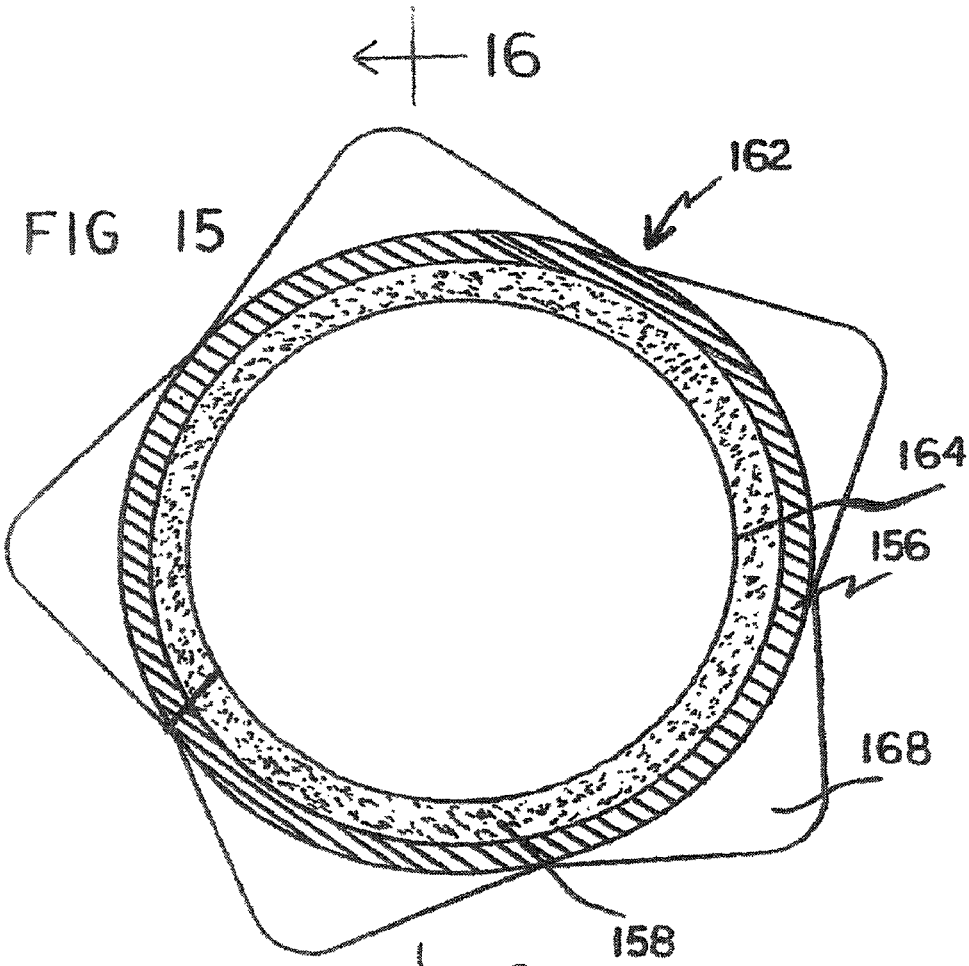
FIG. 15 provides a cross-sectional view looking down onto an embodiment of a star-shaped coolant base.
Figure 16:
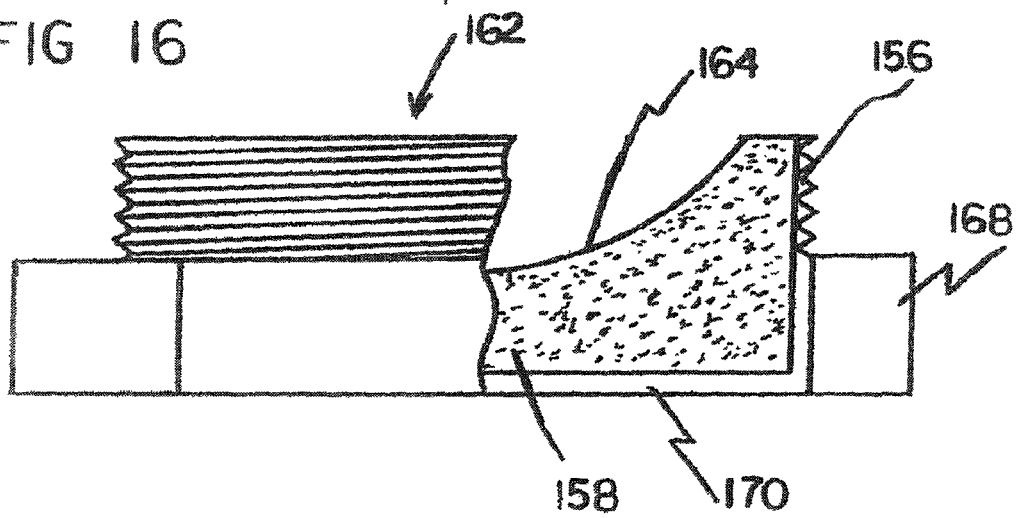
FIG. 16 is a cutaway view of the base of FIG. 15 along line 16-16.

FIGS. 15 and 16 provide different views of base 162 with FIG. 15 providing a cross-sectional view from the top and FIG. 16 providing a cutaway view from the side. Inner wall 164 is shaped to conform to a corresponding outer wall on a beverage container. The star-shaped base includes extensions 168 that can help to stabilize the container as well as to provide for a solid grip to aid with tightening and loosening of the base to the beverage container. Extensions 168 may be sized and spaced to fit comfortably to an adult hand while being too large and spaced apart for a child's hand. Thus, the base may be easily attached and removed by an adult but not by a curious or fidgety child. Male threads 156 can mate with corresponding threads on a matching beverage container, such as a sippy cup. Coolant 158 can be maintained cold with the assistance of insulation layer 170.

Figure 17:
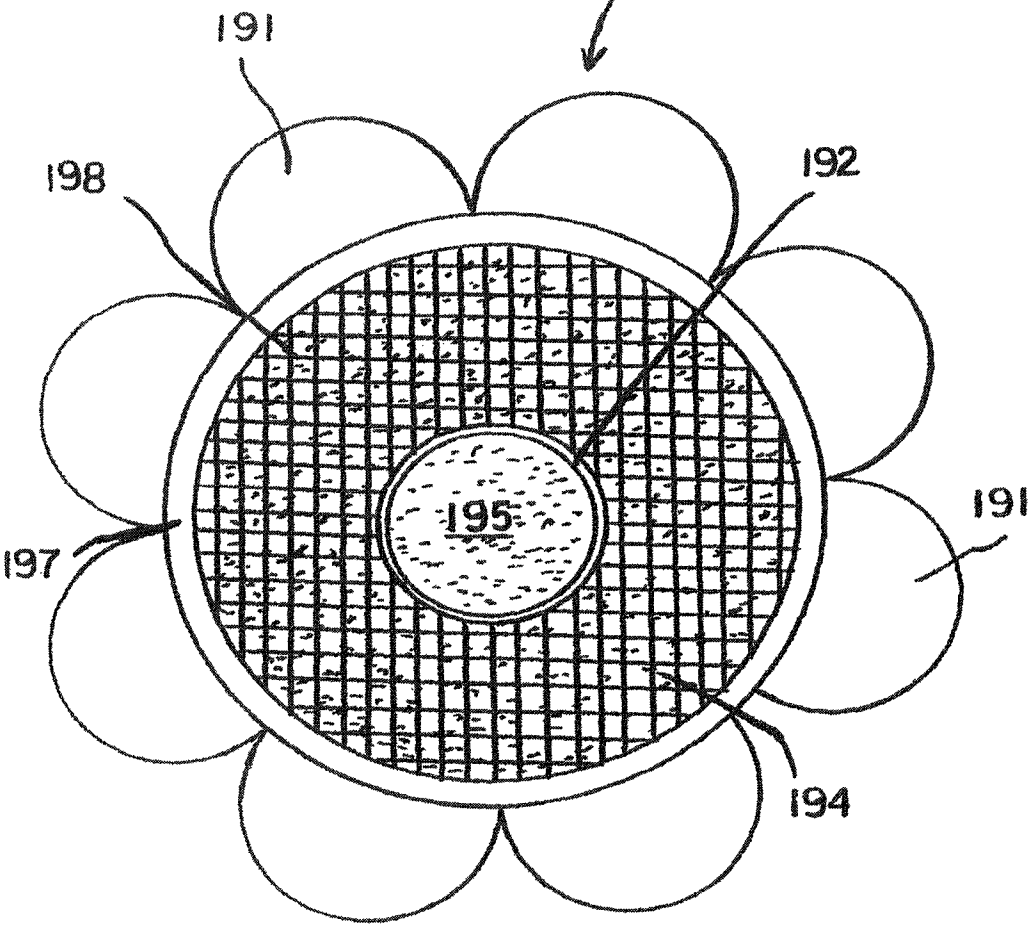
FIG. 17 provides a cross-sectional view looking down onto an embodiment of a flower-shaped coolant base.

FIG. 17 provides a plan view looking at the top of base 190 that includes a flower-like arrangement of protrusions 191 around the perimeter of the base. The base includes coolant region 198 and internal threads 192 that may be either female or male threads. The coolant region may be extended to protrusions 191 to provide extra thermal capacity. Thermally conductive mesh 194 is embedded in the top surface of the base and may aid in the transfer of heat from the beverage (not shown) to the coolant. Mesh 194 may pass partially or entirely through a plastic layer forming the upper surface of coolant base 190. The mesh may be made from a thermally conductive material such as copper or other metal. Cavity 195 may also contain coolant. Double wall 197 provides insulation to help prevent heat absorption from the ambient environment. This double wall design can be carried to the bottom surface of the base as well. The space between the double wall may be filled with air, evacuated or contain an insulative material such as expanded foam. If protrusions 191 contain coolant, the protrusion walls may also be insulated.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

The indefinite articles "a" and "an," as used herein in the specification and in the claims, unless clearly indicated to the contrary, should be understood to mean "at least one."

All references, patents and patent applications and publications that are cited or referred to in this application are incorporated in their entirety herein by reference.

What is claimed is:

1. A detachable base for regulating the temperature of a beverage container, the beverage container including both an inner wall defining a beverage cavity and an outer wall defining a second cavity for receiving the base, the second cavity surrounding the beverage cavity, the base comprising: an upper portion including a connector for securing the base to the container, the upper portion surrounding the beverage cavity and seated in the second cavity when the base is secured to the beverage container; and a lower portion constructed and arranged to extend below the lowest point on the base of the container when the base is fully secured to the beverage container, the upper and lower portions including a coolant wherein at least 25% of the volume of the coolant resides in the lower portion.

2. The detachable base of claim 1 wherein the coolant is contained in a single coolant chamber.

3. The detachable base of claim 1 wherein the outer diameter of the base at the point of attachment to the container is substantially equal to the outer diameter of the container.

4. The detachable base of claim 1 wherein the connector comprises threads.

5. The detachable base of claim 1 wherein at least 50% of the volume of the coolant resides in the lower portion.

6. The detachable base of claim 1 wherein the lower portion includes an outer wall having a diameter at least as great as is the diameter of the beverage container at the point of attachment with the base.

7. The detachable base of claim 1 wherein the upper portion includes a top wall that substantially conforms to a bottom surface of the beverage container.

8. The detachable base of claim 1 wherein the lower portion is non-circular.

9. The detachable base of claim 1 wherein the lower portion includes an outer wall, the outer wall having an average thickness of 2 mm or greater.

10. The detachable base of claim 1 wherein the lower portion includes an outer wall that comprises at least two layers.

11. A combination comprising: a beverage container including at least an inner side wall and an outer side wall, the inner side wall defining a beverage cavity, the inner wall and the outer side wall defining a second cavity there between that surrounds the beverage cavity, and a lower rim at the lower most portion of the container; a base separable from the beverage container, the base including an upper portion and a lower portion, the upper portion having an exterior wall and an interior wall, the exterior and interior walls defining a coolant chamber that is seated in the second cavity when the base and beverage container fully connected together; a sealed coolant in both the upper and lower portions; and a connector securing the beverage container to the base wherein at least 10% of the volume of the coolant is positioned below the lowest point on the beverage container when the base is fully connected to the beverage container.

12. The combination of claim 11 wherein the coolant is contained in a single coolant chamber.

13. The detachable base of claim 11 wherein the outer diameter of the base at the point of attachment to the container is substantially equal to the outer diameter of the container.

14. The combination of claim 11 wherein the connector comprises complementary threads on the beverage container and the base.

15. The combination of claim 11 wherein the height of the combination is at least 1 cm greater than the height of the beverage container.

16. The combination of claim 11 wherein the lower portion includes a non-round outer wall.

17. The combination of claim 16 wherein the outer wall is polygonal.

18. The combination of claim 11 wherein the lower portion includes an outer wall that is substantially out of alignment with the outer wall of the beverage container.

19. The combination of claim 11 wherein the lower portion includes an outer wall having a thickness of greater than 2 mm.

* * * * *